US006173130B1

(12) United States Patent
Oguma

(10) Patent No.: US 6,173,130 B1
(45) Date of Patent: Jan. 9, 2001

(54) DEVELOPMENT AGENT CONTAINER, PROCESS CARTRIDGE, AND IMAGE FORMING APPARATUS

(75) Inventor: Toru Oguma, Mishima (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/409,251

(22) Filed: Sep. 30, 1999

(30) Foreign Application Priority Data

Oct. 1, 1998 (JP) ..... 10-279543

(51) Int. Cl.[7] ..... G03G 15/08
(52) U.S. Cl. ..... 399/27; 399/64; 399/254
(58) Field of Search ..... 399/27, 30, 58, 399/61, 62, 64, 111, 119, 120, 258, 254; 222/DIG. 1

(56) References Cited

U.S. PATENT DOCUMENTS 5,287,151 * 2/1994 Sugiyama ..... 399/258
5,557,368 * 9/1996 Endo et al. ..... 399/27
5,568,233 * 10/1996 Komada ..... 399/30
5,649,264 * 7/1997 Domon et al. ..... 399/30
5,870,652 * 2/1999 Kanamori et al. ..... 399/106

* cited by examiner

*Primary Examiner*—Sophia S. Chen
(74) *Attorney, Agent, or Firm*—Fitzpatrick, Cella, Harper & Scinto

(57) ABSTRACT

A development-agent container includes a development-agent containing unit for containing development agents for developing latent images formed on an image carrier; a light-transmission window formed at a frame of the development-agent containing unit for detecting a remaining amount of the development agents in the development-agent containing unit and a stirring member disposed in the development agent containing unit for stirring the development agents. The stirring member has a light-shielding flexible sheet for rubbing the light-transmission window.

10 Claims, 6 Drawing Sheets

DEVELOPMENT AGENT CONTAINER, PROCESS CARTRIDGE, AND IMAGE FORMING APPARATUS

BACKGROUND OF THE INVENTION

1. Field of the Invention

This invention relates to a development-agent container for containing development agents in a development apparatus in an electrophotographic image forming apparatus, a process cartridge, and an image forming apparatus.

2. Related Background Art

In an image forming apparatus of an electrophotographic system, in other words, in an apparatus for obtaining images by developing with development agents, electrostatic latent images on an image carrier, such as a photosensitive drum or the like, it is required to supply development agents as expendables. As a method for supplying development agents, there are the following methods.

First of all, a development-agent receiving container is installed in an image forming apparatus body, such as a photocopier or the like, and a development-agent supplying container, filled with development agents in advance for supplying development agents, is prepared as another expendable, independent from the image forming apparatus, and when the development-agent receiving container comes to have the smaller remaining amount of the development agents, the development agents in the development-agent supplying container are supplied, as a supplying method, in the whole amount at once to the development-agent receiving container.

As another method, there is a method using a stationary container, in which, though a development-agent supplying container is prepared in the same way as the above method, after a development-agent supplying container is attached to the image forming apparatus body without supplying the agents in the whole amount, the development-agent supplying container is left over as it is in the image forming apparatus body, and the development agents are gradually delivered toward a development apparatus by operating a development-agent stirring apparatus until the development agents are used up.

In addition, there is a process cartridge method in which a photosensitive drum, a cleaning apparatus, and a development apparatus filled in advance with development agents, are formed unitedly and in which those elements are detachably attached to the image forming apparatus body. In this method, development agents are delivered gradually to a development sleeve and a photosensitive drum from a development-agent containing section formed in the cartridge by operating a development-agent stirring apparatus until the incorporated development agents are used up where the cartridge is attached once in the image forming apparatus body.

However, in all the methods, it is required to detect the remaining amount of the development agents in the development-agent container, and the remaining amount is detected by a light transmission method, an antenna method, and like.

FIG. 5 is an illustration of a development apparatus performing detection of the development-agent remaining amount through a light transmission method; FIG. 6 is a diagram illustrating the relation between a toner-remaining amount and a light-transmission time. A development apparatus 100 shown in FIG. 5 is structured of a development unit 107 in which a development sleeve 105, a development agent supplying roller 106, and so on are installed, and a development-agent container 104 welded thereto for containing the development agents. Light-transmission windows 101, 102 for detecting the development-agent remaining amount are attached to the development-agent container 104. A stirring member 103 is rotatively attached to the interior of the development-agent container 104 to stir the toners T serving as development agents, and is driven in an arrow AA direction by a drive means, not shown. The stirring member 103 is constituted of a stirring stay 103*a* connected to the drive means and a flexible stirring sheet 103*b* for removing the toners clinging to the light-transmission windows 101, 102.

In the image forming apparatus body, a light-emitting portion 108 and a light-receiving portion 109 are arranged, and the detection light L is emitted from the light emitting portion 108, transmitted through the light transmission windows 101, 102, and received at the light-receiving portion 109 to detect the remaining amount of the development agents T in the development agent container 104. More specifically, the detection light L is emitted for a period while the stirring member 103 rotates for one turn, and time t that light transmits in the development-agent container 104 is detected during this period. When this amount exceeds a prescribed threshold t1, it is judged as toners remain in a small amount, and the apparatus notifies it to the users.

With the development apparatus thus structured, though the stirring sheet 103*b* is structured to wipe the surfaces of the light-transmission windows 101, 102 by a rotation of the stirring member 103 during the detection operation, the stirring sheet 103*b* is at a position shielding the detection light L from starting wiping the light-transmission window 101 to ending wiping the light-transmission window 102. Although a flexible sheet, such as PET, is frequently used for a material of the stirring sheet, such a conventional sheet is generally transparent or semitransparent, which has low light-shielding property.

Where the toner-remaining amount is relatively large in the development-agent container 104, toners clings to the surface of the stirring sheet 103*b* in a large amount, and when the stirring sheet 103*b* is on a beam axis of the detection light L, the stirring sheet 103*b* also shields the detection light L. However, if the toner-remaining amount become small, situations that the sheet can shield the light and cannot shield the light may occur, depending on the toner amount clinging to the stirring sheet 103*b*. In addition to the toner-clinging degree on the stirring sheet, situations that the sheet can shield the light and cannot shield the light may occur depending on differences in the light emitting of the detection light and sensitivity of the light receiving sensor.

FIG. 6 is a graph showing a relation between a toner amount in the development-agent container 104 and the transmission time t of the detection light. If the toner amount M is reduced, the transmission time t increases, and when the time t exceeds the threshold t1, the apparatus issues a warning of "empty of toner amount." However, as described above, with the conventional structure, where the toner amount is small, the stirring sheet 103*b* may shield light in some case but may not shield light in other cases, and when the light is shielded, it becomes a curve as shown with numeral S1, whereas when the light is not shielded, it becomes a curve as shown with numeral S2. The toner-remaining amount M where the transmission time t exceeds the threshold t1 is M1 when the light is shielded and M2 when the light is not shielded, and generates large differences.

SUMMARY OF THE INVENTION

It is an object of the invention to provide a development-agent container, a process cartridge, and an image forming apparatus capable of detecting toner-remaining amounts stably and surely without being affected by toners clinging to a stirring sheet.

A representative structure of a development agent container according to the invention to accomplish the above object includes a development-agent containing unit for containing development agents for developing latent images formed on an image carrier; a light-transmission window formed at a frame of the development agent containing unit for detecting a remaining amount of the development agents in the development-agent containing unit; and a stirring member disposed in the development-agent containing unit for stirring the development agents, the stirring member having a light-shielding flexible sheet for rubbing the light-transmission window.

Where the flexible sheet is made of a synthetic resin sheet having flexibility, with a carbon coating thereon, the flexible sheet can be structured to have an adequate light-shielding property.

As another structure of the invention, a development cartridge includes, at least, developing means for developing latent images on an image carrier with development agents; and a development-agent container including: a development-agent containing unit for containing development agents for developing latent images formed on an image carrier; a light-transmission window formed at a frame of the development-agent containing unit for detecting a remaining amount of the development agents in the development-agent containing unit; and a stirring member formed in the development-agent containing unit for stirring the development agents, the stirring member having a light-shielding flexible sheet for rubbing the light transmission window.

As yet another structure of the invention a process cartridge includes, at least, an image carrier for carrying latent images; developing means for developing latent images on an image carrier with development agents; a housing for supporting the image carrier and the developing means; and a development-agent container including: a development-agent containing unit for containing development agents for developing latent images formed on an image carrier; a light-transmission window formed at a frame of the development-agent containing unit for detecting a remaining amount of the development agents in the development-agent containing unit; and a stirring member formed in the development-agent containing unit for stirring the development agents, the stirring member having a light-shielding flexible sheet for rubbing the light-transmission window.

An image forming apparatus according to the invention includes: an image carrier for carrying latent images; developing means for developing latent images on an image carrier with development agents; a housing for supporting the image carrier and the developing means; a development agent container including: a development-agent containing unit for containing development agents for developing latent images formed on an image carrier; a light-transmission window formed at a frame of the development agent containing unit for detecting a remaining amount of the development agents in the development-agent containing unit; and a stirring member formed in the development-agent containing unit for stirring the development agents, the stirring member having a light-shielding flexible sheet for rubbing the light-transmission window; and remaining amount detecting means for development agents having a light-emitting portion and a light-receiving portion of light transmitting through the light-transmission window.

DETAILED DESCRIPTION OF THE PREFERRED EMBODIMENTS

Figure 1:
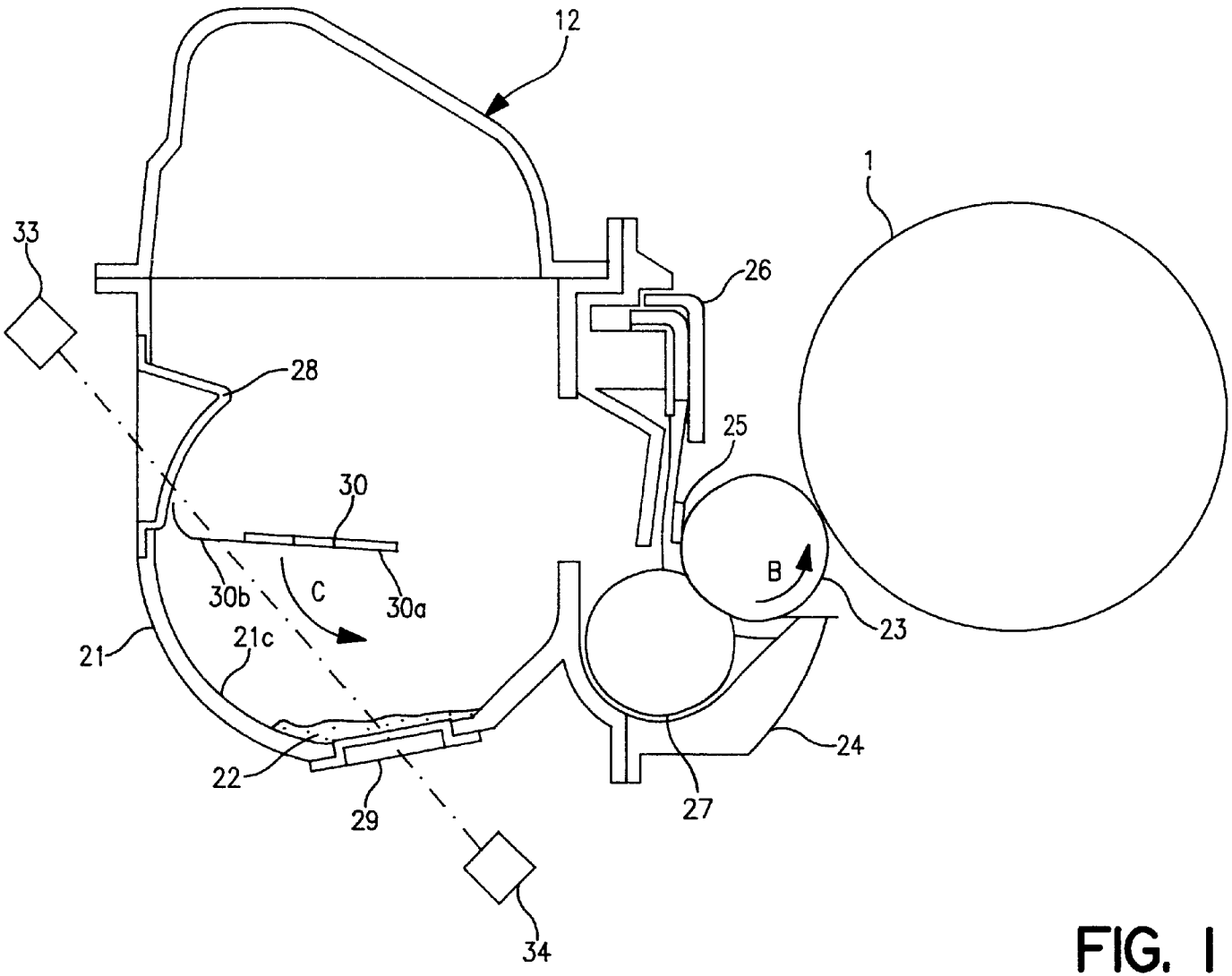
FIG. 1 is a structural diagram showing a development apparatus according to an embodiment.
Figure 2:
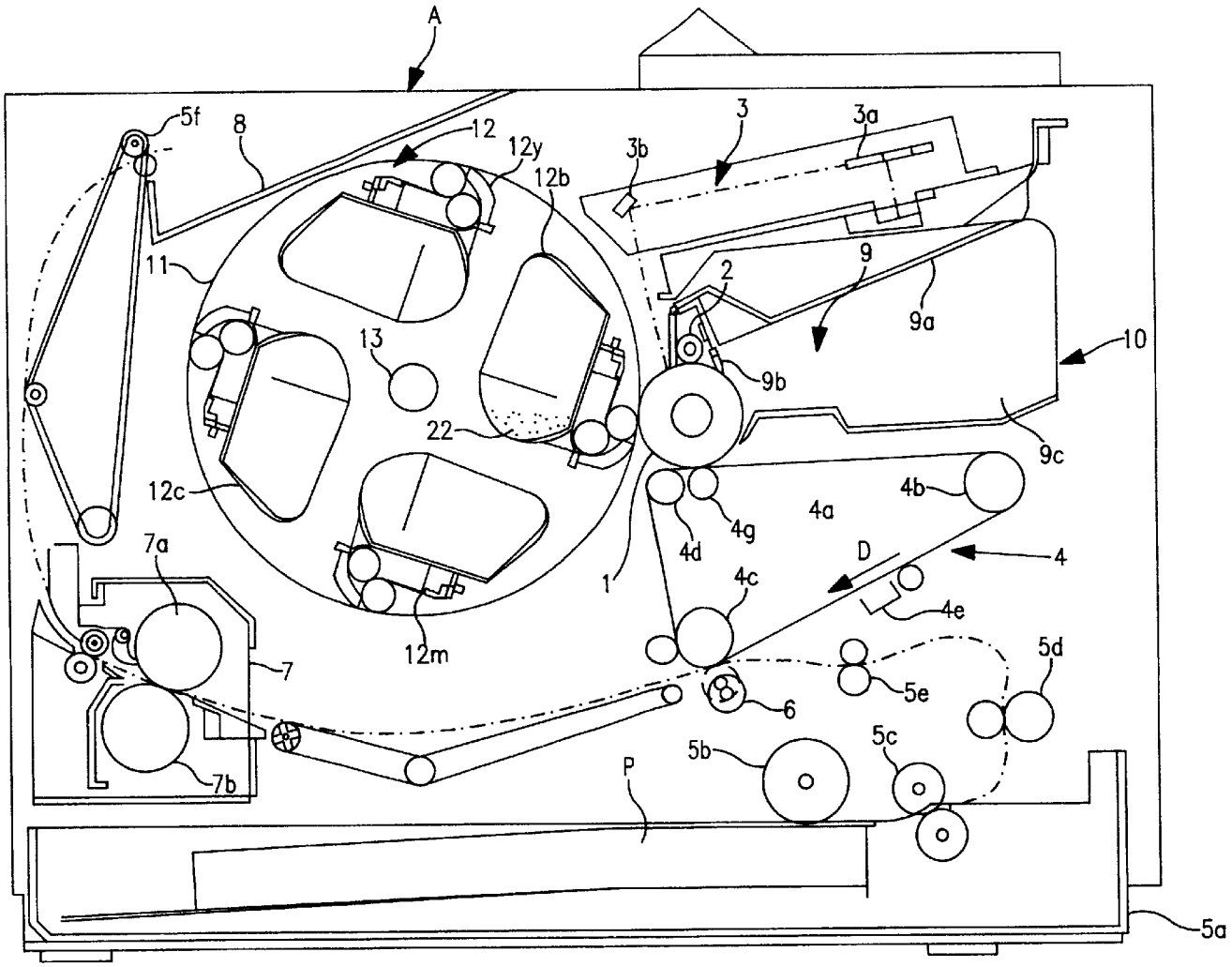
FIG. 2 is a view showing the whole structure of an image forming apparatus according to an embodiment.
Figure 3:
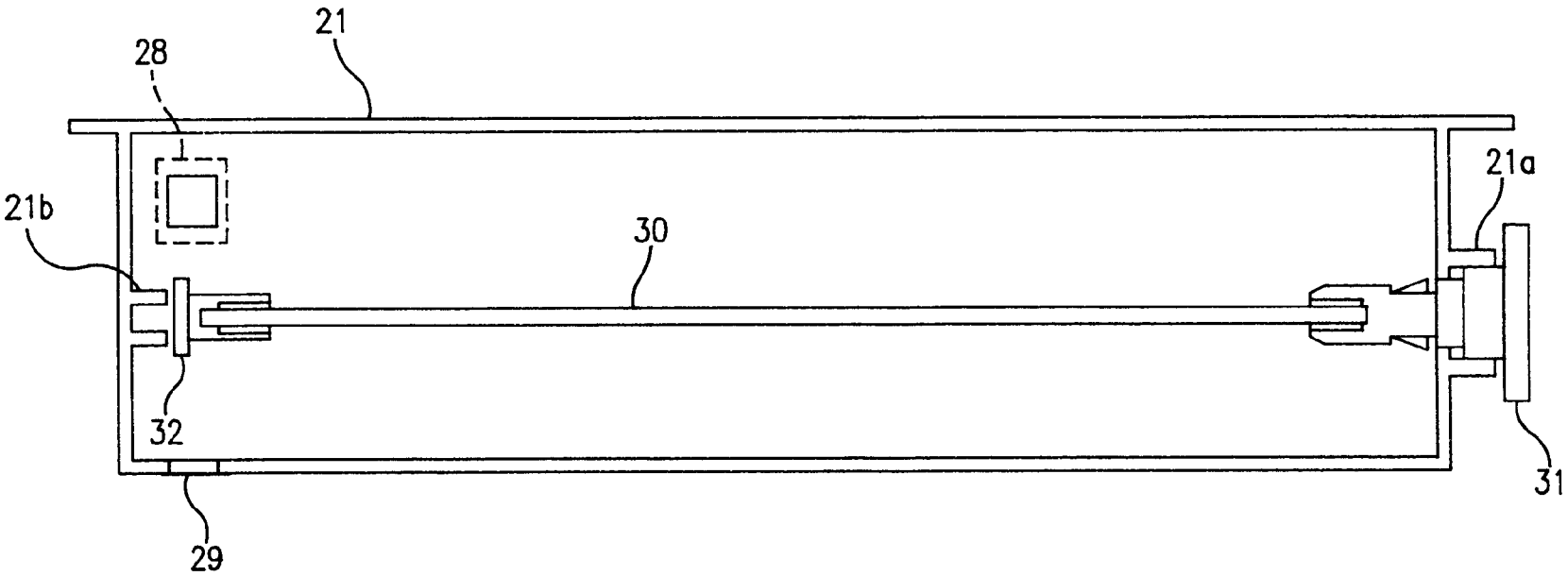
FIG. 3 is a view illustrating a stirring member.
Figure 4:
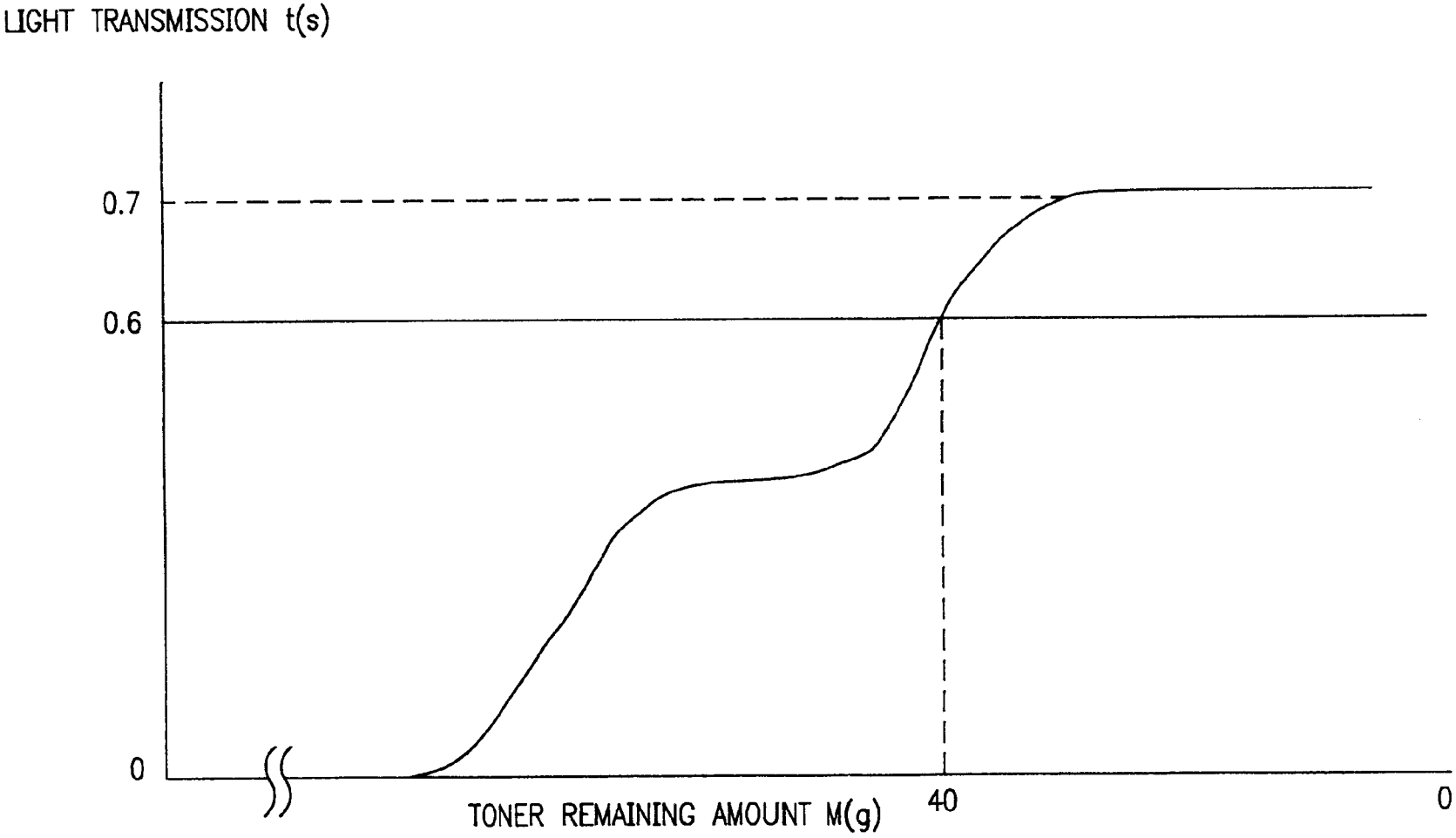
FIG. 4 is a diagram showing the relation between toner-remaining amount of the development-agent container and the transmission time.
Figure 5:
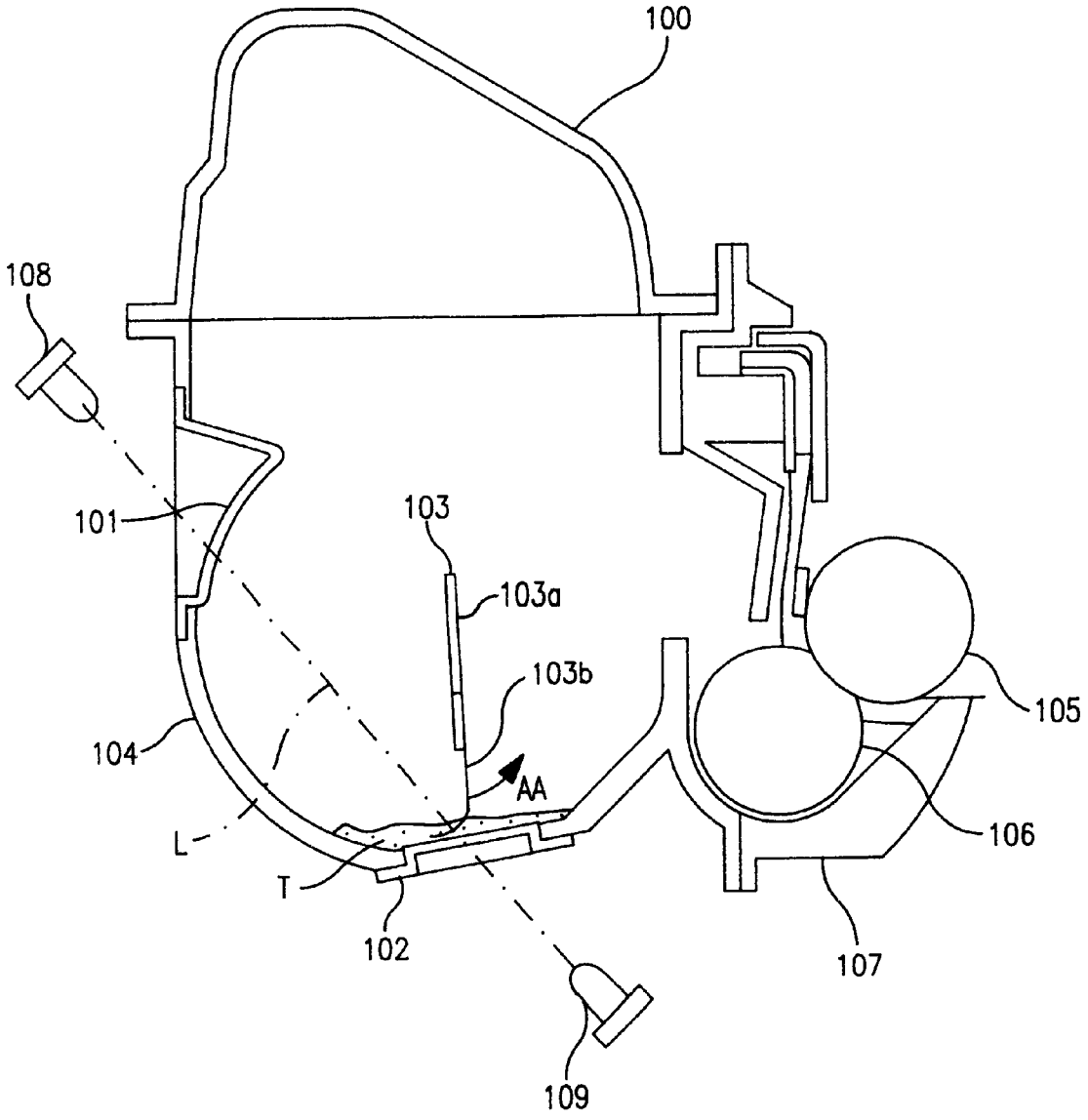
FIG. 5 PRIOR ART
FIG. 5 is a schematic view of a development apparatus for detecting the development-agent remaining amount by a light-transmission method according to a prior art.
Figure 6:
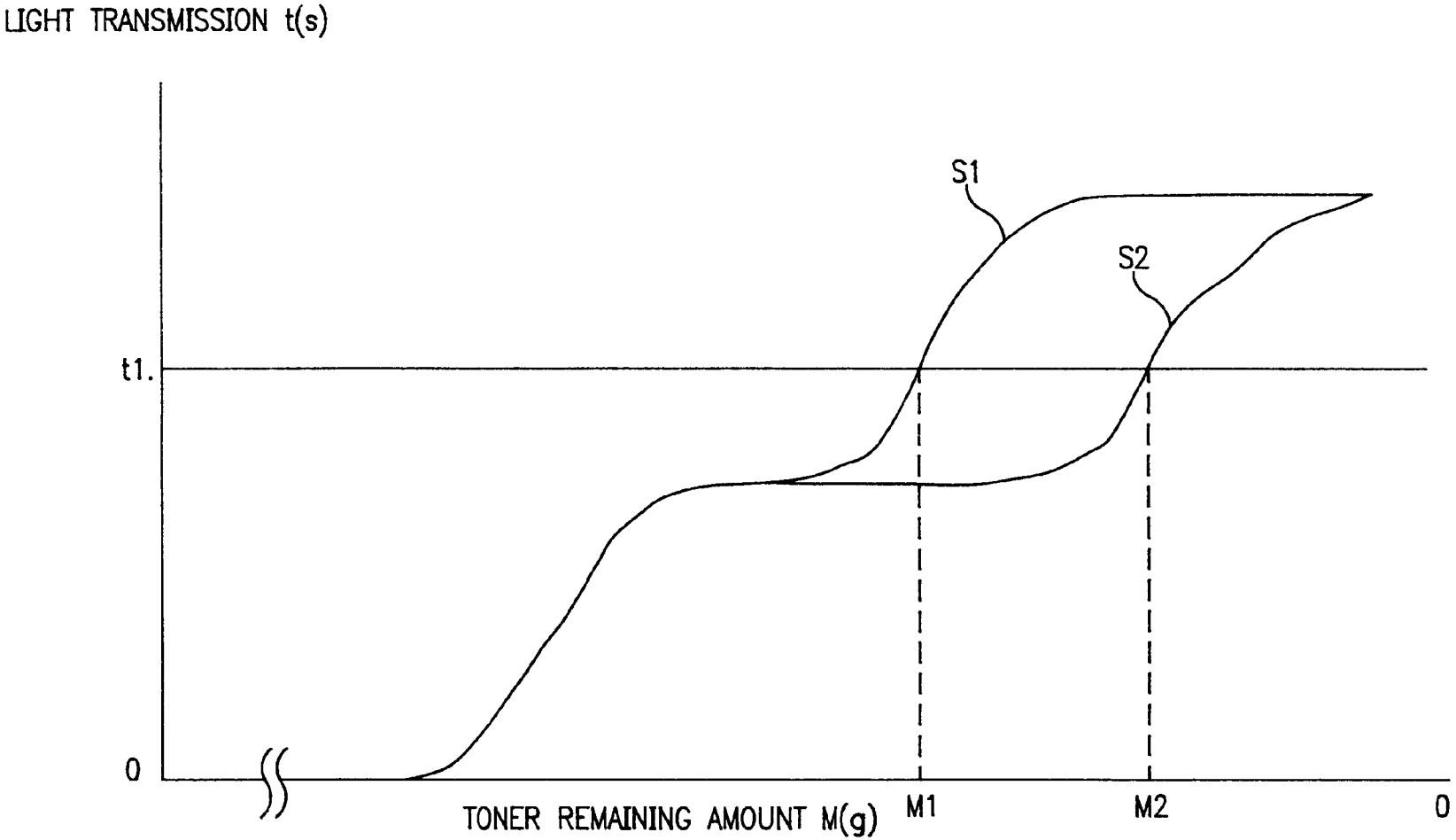
FIG. 6 PRIOR ART
FIG. 6 is a diagram showing the relation between toner-remaining amount of the prior art and transmission time of light.

Hereinafter, referring to the drawings, an embodiment of a development-agent container and a development apparatus according to the invention is described. FIG. 1 is a structural diagram showing a development apparatus according to an embodiment; FIG. 2 is a view showing the whole structure of an image forming apparatus according to an embodiment; FIG. 3 is a view illustrating a stirring member; FIG. 4 is a diagram showing the relation between the toner-remaining amount of the development-agent container and transmission time.

[Whole Structure]

The image forming apparatus shown in FIG. 2 is a laser beam printer as an embodiment of an image forming apparatus for forming color images in use of an electrophotographic method. A charging means 2 uniformly charges the surface of the electrophotographic photosensitive body (hereinafter referred to as "photosensitive (drum 1") as an image carrier in a drum shape rotating at a constant rate, and latent images are formed by projecting a laser beam corresponding to the image information from exposing means 3. These latent images are developed by four development apparatuses 12*m*, 12*c*, 12*y*, 12*b* (hereinafter, referred to as "development apparatuses 12" collectively), and color images are produced by sequentially transferring images made of visualized development agents (hereinafter referred to as toners 22) onto an intermediate transfer body 4 in a belt shape.

These color images are transferred by transferring means 6 onto a recording medium P (e.g., recording paper, OHP sheet or the like) conveyed by conveying means from a feeding section. The recording medium P is conveyed to fixing means 7 to fix the color images and delivered onto a delivery portion 8 on a top of the apparatus.

[Process Cartridge]

Next, structures of respect portions are described. The photosensitive drum 1 is structured, as a process cartridge, unitedly with the charging means 2 and a cleaning means 9, and detachably attached to the image forming apparatus body. The user can replace it according to the life span of the photosensitive drum.

The photosensitive drum 1 is structured with a coating of an organic photoconductive layer on an outer surface of an aluminum cylinder having a diameter of about 50 mm. The photosensitive drum 1 is rotatively supported to a frame 9*a* in a shape of a container for the cleaning means 9 also serving as a holder for the photosensitive drum 1, and is rotatively driven in a counterclockwise direction in FIG. 1 by drive force of a drive motor, not shown.

The charging means 2 is disposed on a round surface of the photosensitive drum 1. The charging means 2 according to this embodiment uses a so-called contact charging method, and charges uniformly the surface of the photosensitive drum 1. In the exposing means 3 for exposing the photosensitive drum 1 thus charged, a laser diode, not shown, radiates to a polygon mirror 3*a* image light corresponding to an image signal where the image signal is fed to the laser diode. The polygon mirror 3*a* rotates at a high speed by means of a scanner motor, and image light reflected on the polygon mirror selectively exposes the surface of the photosensitive drum 1 that rotates at a constant rate via a reflection mirror 3*b* to form latent images.

The cleaning means 9 is similarly disposed on the round surface of the photosensitive drum 1. The cleaning means 9 is constituted of the frame 9*a*, the cleaning blade 9*b*, and the waste toner container 9*c*, and toners 22 that remain on the photosensitive drum 1 are wiped out by a cleaning blade 9*b* and thereby stored in the waste toner container 9*c*. The waste toner container 9*c* is formed with a capacity that will not be filled before the photosensitive drum 1 reaches the end of the life span and is replaced unitedly with the process cartridge 10 when the process cartridge 10 is replaced upon reaching the end of the life span.

[Intermediate Transfer Body]

The latent images thus formed are developed by the development apparatuses 12 with respect to each color, and the toner images thus visualized are transferred onto an intermediate transfer body 4. As described above, the respective color toner images are overlapped on an intermediate transfer belt 4*a* of the intermediate transfer body 4, thereby forming color images.

The intermediate transfer belt 4*a* is a belt having a peripheral length of about 440 mm and is tensioned by three rollers: a drive roller 4*b*, a secondary transfer opposing roller 4*c*, and a driven roller 4*d*, and travels in an arrow D direction as shown in FIG. 2. A belt pushing roller 4*g* is provided near the drive roller 4*d* and is structured to urge the intermediate transfer belt 4*a* toward the photosensitive drum 1 and to release urging the belt.

A cleaning unit 4*e*, capable of contacting to and separating from the surface of the intermediate transfer belt 4*a*, is formed at a predetermined position of the outside of the intermediate transfer belt 4. The cleaning unit 4 removes post-transfer remaining toners that remain after being secondarily transferred at a time onto a recording medium P as described below. The cleaning unit 4*e* gives the toners 22 charges that are reverse to those during transfer by contacting the charging roller to the intermediate transfer belt 4*a*, and thereby, the toners 22 are adhered electrostatically to the photosensitive drum 1 and subsequently collected by the cleaning means 9 for the photosensitive drum 1. It is to be noted that as a method for cleaning the intermediate transfer belt 4*a*, not only an electrostatic cleaning method as described above, but also a mechanical method, such as a blade or a fur blush or a combination of those, can be used.

[Transferring Means]

The transferring means 6, for transferring to the recording medium P the toner images multiply transferred onto the intermediate transfer body 4, is structured of a roller in this embodiment. The roller is formed of a metal shaft wound by a foamed elastic body having an intermediate resistance and is arranged as to be movable in a vertical direction in the drawing.

The transferring means 6 takes a lower position as shown with a solid line in FIG. 2 and is separated from the intermediate transferring body 4 so as not to disturb the images while the four color toner images are formed on the intermediate transfer body 4, or namely while the intermediate transfer body 4 rotates multiple times.

The transferring means 6 moves to an upper position as shown with a broken line by means of a cam, not shown, in meeting with a timing when the color images are transferred onto the recording medium P after the color images are formed on the intermediate transfer body 4 upon overlapping the toner images. The transferring means 6 then comes in pressurized contact with the intermediate transfer body 4 via the recording medium P. A bias voltage is fed to the transferring means 6 at the same time, and thereby the toner image on the intermediate transfer body 4 is transferred on the recording medium P.

[Conveying Means]

The conveying means for conveying the recording medium P includes a feeding cassette 5*a* for containing recording media P of multiple sheets, a pickup roller 5*b*, a feeding roller pair 5*c* composed of a feeding roller and a retard roller, a conveyance roller pair 5*d*, a register roller pair 5*e*, a delivery roller pair 5*f*, and so on.

When images are formed, the recording media P are sent from the feeding cassette 5*a* by the pickup roller 5*b* and are conveyed upon separating the recording media sheet by sheet by means of the feeding roller pair 5*c* to the register roller pair 5*e* by way of the conveyance roller pair 5*d*. The register roller pair 5*e* performance non-rotation operation and a rotation operation with a predetermined sequence synchronously with the intermediate transfer body 4 and corrects oblique feeding of the recording medium P, as well as transfers the color images by sending the recording medium P to the nip portion between the intermediate transfer body 4 and the transferring means 6.

[Fixing Means]

The recording medium P on which the color images are transferred is transferred to the fixing means 7 made of a fixing roller 7*a* for applying heat on the recording medium P and a pressure roller 7*b* for pressing the recording medium P to the fixing roller 7*a*, and toner images are fixed to the recording medium P. The fixing roller 7*a* and the pressure roller 7*b* are hollow rollers, in which respective heaters are provided, and are driven rotatively. The toner images are fixed to the recording medium P by conveyance in applying heat and pressure to the recording medium P. The recording medium P on which the images are fixed is delivered to the delivery portion 8 by the delivery roller pair 5*f* constituting the conveying means.

[Development Apparatus]

Next, the structure of the development apparatus for developing latent images formed on the photosensitive drum 1 is described. The image forming apparatus requires development of respective colors: yellow, magenta, cyan, and black, to form full color images, and has development apparatuses 12*y*, 12*m*, 12*c*, 12*b* (hereinafter referred to as "development apparatuses 12" collectively) for respective colors.

Those development apparatuses 12 are cartridges (development cartridge) detachably attached to a rotary unit 11 that rotates around a shaft 13 as a center, and when images are formed, the development apparatuses 12 are rotatively driven around the shaft 13 as held by the rotary unit 11. The development apparatus 12 containing toners 22 of a prescribed color is stopped at a position opposite to the photosensitive drum 1, and latent images are developed by supplying toners 22 corresponding to the electrostatic latent images of the photosensitive drum 1 after a development sleeve as described below is positioned so as to oppose to the photosensitive drum 1 and keep a very small gap (about 300 microns).

When a color image is formed, the rotary unit 11 rotates at one rotation of the intermediate transfer body 4, and a development step is made in the order of the yellow development apparatus 12*y* containing yellow color toners, the magenta development apparatus 12*m* containing magenta color toners, the cyan development apparatus 12*c* containing cyan color toners, and the black development apparatus 12*b* containing black color toners.

FIG. 1 shows a state that any one of the development apparatuses 12 is immovably positioned at a development position opposing to the photosensitive drum 1. The development apparatus 12 is structured by unitedly connecting, by ultrasound wielding or the like, the development agent container 21 for containing toners 22 as development agents with a development unit 24 in which a development sleeve 23, an elastic blade 25, an elastic roller, and the like are mounted.

The development unit 24 has the development sleeve 23 as a development agent carrier at an opening extending in a longitudinal direction, and the electrostatic latent images thereon are developed and visualized where the unit 24 is arranged to face to the photosensitive drum 1. The development sleeve 23 is provided transversely in exposing about a half of the round surface, faces to the photosensitive drum with a very small gap, and is drive rotatively in the arrow B direction during the development operation. The elastic roller 27 rotatively contacts about a half of the round surface of the development sleeve 23 located in the development unit 24. The elastic roller 27 has a structure that a sponge is adhered to a core metal, is rotatively driven in a direction the same as the development sleeve 23, and operates to feed the toners 22 to the development sleeve 23 and remove undeveloped toners.

The elastic blade 25 is urged on a downstream side with respect to the elastic roller 27 in the rotational direction of the development sleeve 23. The elastic blade 25 is made of a rubber material such as urethane, silicone, or using a thin metal plate such as SUS or phosphor bronze having spring elasticity as a base in which a rubber material is adhered to a contacting surface to the development sleeve 23. The elastic blade 25 is supported by a blade supporting plate 26 and is attached so that a tip and vicinity on a free end side of the elastic blade 25 is in contact with an outer round surface of the development sleeve 23 with an area contact, thereby controlling the layer thickness of the toners on the development sleeve 23, and applying charges to the toner 22 by a rubbing motion.

Light transmission windows 28, 29 are secured by ultrasound wielding or the like to the frame of the development agent container 21 to provide a light path of the detection light for detecting toner-remaining amount. As a material for the light transmission windows 28, 29, a material such as, e.g., transparent polystyrene such as GP-PS, in which the transmission rate of infrared light of wavelength 900 to 940 nm is guaranteed to be about 80% or higher, and which can be wielded well by ultrasound to the development agent container 21 but hardly receives cracks during wielding, is preferably used, and more preferably added with flame retarders.

A stirring member 30 is formed in the development-agent container 21 to stir the contained toners 22 and to convey the toners 22 toward the development unit 24. The stirring member 30 is made, as shown in FIG. 1 and FIG. 3, of a stirring stay 30*a* and a stirring sheet 30*b*. Opposite ends of the stirring stay 30*a* are supported by a stirring gear 31 and a stirring support member 32. The stirring gear 31 and the stirring support member 32 are rotatively supported by sliding portions 21*a*, 21*b* of the development-agent container 21, respectively, and the stirring member 30 rotates in the arrow C direction where the stirring gear 31 receives the drive force, thereby stirring and conveying the toners 22.

To make stirring and conveying stable, the inner surface 21*c* of the development-agent container 21 has a shape extending along the stirring orbit. The light-transmission window 28 located upward of the container is formed with a curved face extending along the stirring orbit to effectuate the wiping by the stirring member 30. This is because the toner-remaining amount may not be detected accurately if the wiping effect is not so good.

[Operation of Toner Remaining Amount Detection]

Next, the operation for toner-remaining amount detection is described. In the image forming apparatus body, a light guide for guiding the LED light from a body light-emitting portion, not shown, to the development apparatuses 12, and a light guide 34 for guiding the light that has passed through the interior of the development agent container 21 to a body-light-receiving portion, not shown, are arranged at positions corresponding to the light transmission windows 28, 29. With such a structure, when the amount of the toners 22 is not so much in the development-agent container 21, the stirring sheet 30*b* wipes out the toners on the light-transmission windows 28, 29 to ensure the light path, so that the light guided by the light guide 33 to the development apparatuses 12 transmits through the container and is introduced to the light-receiving portion by the light guide 34.

When the amount of the toner 22 is higher in the development agent container 21, the light transmission window 29 is covered soon by the toner even where cleaned by the stirring sheet 30*b*, and therefore, the light is not transmitted through the window. However, the time that the light transmitted through the development-agent container 21 becomes longer as the toners 22 remain less. In this embodiment, the LED light is emitted for a time that the stirring member 30 turns once, and the transmission time t that the light is transmitted through the development-agent container 21 during this turn is detected.

FIG. 4 is a diagram showing the relation between the toner-remaining amount M in the development-agent container 21 and transmission time t per unit time (the stirring member 30 turns once). In this embodiment, a time required for the stirring member 30 to make one turn is one second, but a maximum value of the transmission time t is about 0.7 sec. because the stirring sheet 30*b* shields the light path for about 0.3 sec. From the starting of wiping the light-transmission window 28 to the ending of wiping the light-transmission window 29. In this apparatus, the threshold of the toner-remaining amount detection is set to 0.6 sec., and it is set so that when the transmission time t exceeds this, or namely when the toner-remaining amount M is about 40 g as shown in FIG. 4, a warning "empty of toner amount" is to be issued.

Herein, as a material for the stirring sheet 30*b*, a completely light-shielding flexible sheet having a film thickness of about 70 microns, in which a carbon coating is made on a polyester base, is used. In a prior art, since the LED light may transmit through the stirring sheet 30*b*, the timing of the toner-remaining amount detection becomes unstable when the amount of the toner becomes less as described above, and it may causes fluctuations in a range of 30 g or the like.

In this embodiment, by use of the completely light shielding sheet, such fluctuations are reduced to 5 g or less.

The material of the stirring sheet 30*b* according to the invention is not limited to the material shown in the embodiment, and this invention is applicable by using a material such as urethane rubber or the like having a low clarity or being mixed with pigments having a light reflecting property as far as it ensures the required light-shielding property.

Although in this embodiment, the structure that the invented development-agent container is incorporated as a part of a detachable cartridge in the image forming apparatus body is exemplified, it may be a sole structure of the development-agent container or a structure in which the invented development agent container is incorporated as a part of a process cartridge, and furthermore, the development-agent container is incorporated in the image forming apparatus body where the toner can be supplied by another container.

In addition, although in this embodiment the color image forming apparatus, in which plural development apparatuses having cartridges are incorporated, is exemplified, this invention is applicable to a monochrome image forming apparatus having a single cartridge as a matter of course.

As described above, with the development-agent container and the development apparatus according to the invention, by use of the completely light-shielding sheet for a flexible sheet rubbing the light transmission window for the stirring member, it is possible to provide the development-agent container and the development apparatus, which can stably detect the toner-remaining amount.

What is claimed is:

1. A development agent container comprising:

a development agent containing unit for containing development agents for developing latent images formed on an image carrier;

a light transmission window formed at a frame of the development agent containing unit for detecting a remaining amount of the development agents in the development agent containing unit; and a stirring member disposed in the development agent containing unit for stirring the development agents, the stirring member having a light-shielding flexible sheet for rubbing the light transmission window, the flexible sheet having a carbon coating on a synthetic resin sheet having flexibility.

2. A development agent container comprising:

a development agent containing unit for containing development agents for developing latent images formed on an image carrier;

a light transmission window formed at a frame of the development agent containing unit for detecting a remaining amount of the development agents in the development agent containing unit; and a stirring member disposed in the development agent containing unit for stirring the development agents, the stirring member having a light-shielding flexible sheet for rubbing the light transmission window, the flexible sheet having the complete light-shielding property.

3. A development cartridge comprising:

developing means for developing latent images on an image carrier with development agents; and a development agent container comprising:

a development agent containing unit for containing development agents for developing latent images formed on the image carrier;

a light transmission window formed at a frame of the development agent containing unit for detecting a remaining amount of the development agents in the development agent containing unit; and a stirring member disposed in the development agent containing unit for stirring the development agents, the stirring member having a light-shielding flexible sheet for rubbing the light transmission window, the flexible sheet having a carbon coating on a synthetic resin sheet having flexibility.

4. The development cartridge according to claim 3, wherein the development agent containing unit of the development agent container is formed unitedly with a housing of the development cartridge.

5. A development cartridge comprising:

developing means for developing latent images on an image carrier with development agents; and a development agent container comprising:

a development agent containing unit for containing development agents for developing latent images formed on an image carrier;

a light transmission window formed at a frame of the development agent containing unit for detecting a remaining amount of the development agents in the development agent containing unit; and a stirring member disposed in the development agent containing unit for stirring the development agents, the stirring member having a light-shielding flexible sheet for rubbing the light transmission window, the flexible sheet having the complete light-shielding property.

6. A process cartridge comprising:

an image carrier for carrying latent images;

developing means for developing latent images on an image carrier with development agents;

a housing for supporting the image carrier and the developing means; and a development agent container comprising:

a development agent containing unit for containing development agents for developing latent images formed on the image carrier;

a light transmission window formed at a frame of the development agent containing unit for detecting a remaining amount of the development agents in the development agent containing unit; and a stirring member disposed in the development agent containing unit for stirring the development agents, the stirring member having a light-shielding flexible sheet for rubbing the light transmission window, the flexible sheet having a carbon coating on a synthetic resin sheet having flexibility.

7. The process cartridge according to claim 6, wherein the development agent containing unit of the development agent container is formed unitedly with a housing of a development cartridge.

8. A process agent container comprising:

an image carrier for carrying latent images;

developing means for developing latent images on an image carrier with development agents;

a housing for supporting the image carrier and the developing means; and a development agent container comprising:

a development agent containing unit for containing development agents for developing latent images formed on the image carrier;

a light transmission window formed at a frame of the development agent containing unit for detecting a remaining amount of the development agents in the development agent containing unit; and a stirring member disposed in the development agent containing unit for stirring the development agents, the stirring member having a light-shielding flexible sheet for rubbing the light transmission window, the flexible sheet having the complete light-shielding property.

9. An image forming apparatus comprising:

an image carrier for carrying latent images;

developing means for developing latent images on an image carrier with development agents;

a housing for supporting the image carrier and the developing means;

a development agent container comprising:

a development agent containing unit for containing development agents for developing latent images formed on the image carrier;

a light transmission window formed at a frame of the development agent containing unit for detecting a remaining amount of the development agents in the development agent containing unit; and a stirring member disposed in the development agent containing unit for stirring the development agents, the stirring member having a light-shielding flexible sheet for rubbing the light transmission window; and remaining amount detecting means for development agents having a light emitting portion and a light receiving portion of light transmitting through the light transmission window, the flexible sheet having a carbon coating on a synthetic resin sheet having flexibility.

10. The image forming apparatus, comprising:

an image carrier for carrying latent images;

developing means for developing latent images on the an image carrier with development agents;

a housing for supporting the image carrier and the developing means;

a developing agent container comprising:

a developing agent containing unit for containing development agents for developing latent images formed on the image carrier;

a light transmission window formed at a frame of the development agent containing unit for detecting a remaining amount of the development, agents in the development agent containing unit; and a stirring member disposed in the development agent containing unit for stirring the development agents, the stirring member having a light-shielding flexible sheet for rubbing the light transmission window; and remaining amount detecting means for development agents having a light emitting portion and a light receiving portion of light transmitting through the light transmission window, the flexible sheet having the complete light-shielding property.

* * * * *

UNITED STATES PATENT AND TRADEMARK OFFICE

CERTIFICATE OF CORRECTION

PATENT NO. : 6,173,130 B1
DATED : January 9, 2001
INVENTOR(S) : Toru Oguma

It is certified that error appears in the above-identified patent and that said Letters Patent is hereby corrected as shown below:

Column 6,
Line 30, "performance" should read -- performs a --.

Column 8,
Line 34, "higher" should read -- high --.
Line 40, "toners" should read -- toner. --.
Line 52, "From" should read -- from --.

Column 9,
Line 15, "development agent" should read -- development-agent --.

Signed and Sealed this

Fourth Day of December, 2001

*Attest:*

Nicholas P. Godici

*Attesting Officer*

NICHOLAS P. GODICI
*Acting Director of the United States Patent and Trademark Office*